United States Patent [19]

Swilley

[11] 3,987,903

[45] Oct. 26, 1976

[54] TIE RACK

[76] Inventor: Robert L. Swilley, 1700 Seaspray Court, Apt. 1043, Houston, Tex. 77008

[22] Filed: July 28, 1975

[21] Appl. No.: 599,944

[52] U.S. Cl. ..... 211/13; 211/113; 248/DIG. 3; 248/317

[51] Int. Cl.[2] ..... A47F 5/08

[58] Field of Search ..... 248/309, 311, 314, 317, 248/223, 224, DIG. 3, 300, 304, 301, 307, 360, 318, 216–221, 488, 489, 497; 24/49, 65; 211/13, 113–119, 87, 45, 103

[56] References Cited

UNITED STATES PATENTS

| | | | |
|---|---|---|---|
| 1,140,940 | 5/1915 | Bales | 248/DIG. 3 |
| 3,118,541 | 1/1964 | McKeever et al. | 211/13 |
| 3,168,197 | 2/1965 | Sconza | 211/13 |

FOREIGN PATENTS OR APPLICATIONS

| | | | |
|---|---|---|---|
| 1,542,762 | 9/1968 | France | 248/311 R |
| 1,125,060 | 8/1968 | United Kingdom | 248/DIG. 3 |

*Primary Examiner*—Roy D. Frazier
*Assistant Examiner*—Terrell P. Lewis
*Attorney, Agent, or Firm*—Ranseler O. Wyatt

[57] ABSTRACT

A tie rack having a hanger at one end and a cylindrical body having a plurality of vertical rows of square openings spaced to allow clip-on ties to be suspended therefrom in vertical alignment, and a tie receiving hanger having a squared projection to be fitted in said openings, with a bar for receiving a regular four-in-hand tie to be suspended therefrom.

2 Claims, 4 Drawing Figures

TIE RACK

SUMMARY OF THE INVENTION

A tie rack having rows of vertically aligned, squared openings, adapted to receive the clip of clip-on ties, and a hanger having a bar for receiving four-in-hand ties, and a squared projection extending outwardly and upwardly from said bar, with a flat face on one side, horizontal with relation to said rack, to be seated on the lowermost margin of one of said openings, said projection being adapted to be received by said openings and locked into tie holding position therein.

DESCRIPTION OF THE PREFERRED EMBODIMENTS

Figure 1:
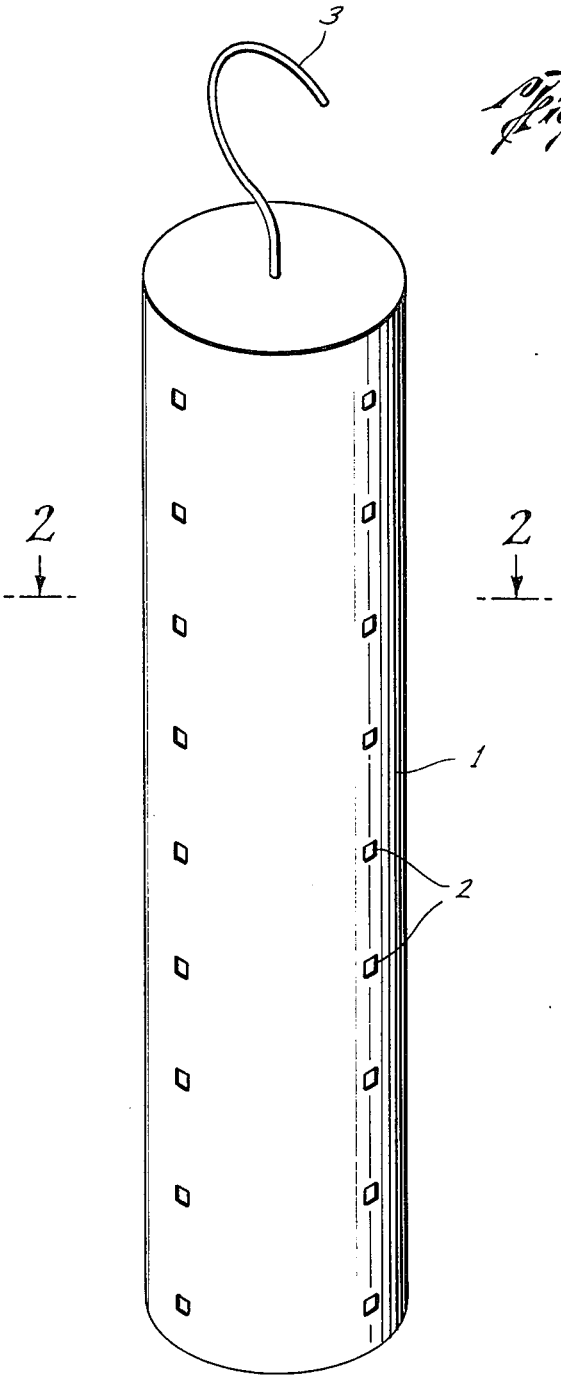
FIG. 1 is a side elevational view of the rack.
Figure 2:
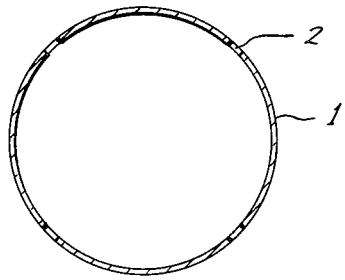
FIG. 2 is a cross sectional end view, taken on the line 2—2 of FIG. 1.

In the drawings, the numeral 1 designates the elongated body, preferably formed in a thin walled cylindrical shape and of light weight material, having the square openings 2, 2 formed in spaced vertical rows, and a suspension means, such as the hanger 3 mounted in the top of the body 1.

The square openings 2, 2 are provided to receive the clip 4 of a clip-on neck tie 5. A tie hanger 6, for hanging four-in-hand ties, consists of a flat elongated bar of about the same width as the openings 2, 2, and being substantially U-shaped, being turned back over itself, with the two portions of the bar spaced apart. A square projection 7 extends laterally from the bar 6 and the bottom surface of the projection being horizontal with the bar for a short distance, the extends upwardly and outwardly. The upper face of the projection extends upwardly and outwardly from the bar 6. To mount the bar 6 on the rack, the projection is inserted in the desired opening 2, with the bar turned upwardly, so that the end face of the projection is parallel with the vertical surface of the rack, and as the projection is moved into the opening, the bar is pivoted downwardly, to place the flat bottom of the projection 7 on the lower surface of the squared opening in which it is seated. This shape of the projection permits the locking of the holder in place, particularly when a four-in-hand tie is suspended from the bar of this holder. The substantially U-shaped bar has the outer portion of greater length than the inner portion, to provide ease in placing a tie on the outer bar, however, the bars may be of equal length, if desired.

Figure 3:
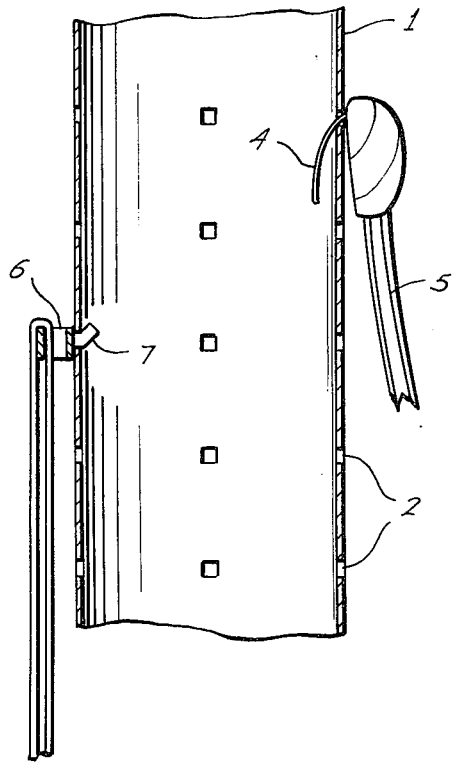
FIG. 3 is a partial, cross sectional, elevational view, with ties in tie housing position.
Figure 4:
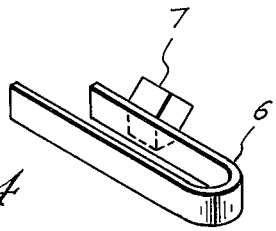
FIG. 4 is a perspective view of the tie holder.

The rack, suspended by the hanger 3, may contain clip-on ties and four-in-hand ties, as shown in FIG. 3, and the said rack may be of any desired length, depending upon the number of ties to be hung therefrom.

What I claim is:

1. In a tie rack, a body member having a suspension means at one end and a series of longitudinal rows of square openings, a four-in-hand tie holder having a substantially U-shaped horizontal bar, a square projection thereon adapted to be mounted in one of said square openings, said projection extending laterally from said bar and being formed to fit closely in said square opening.

2. In a tie rack, a body member having a suspension means at one end and a series of longitudinal rows of square openings, a four-in-hand tie holder having a substantially U-shaped horizontal bar, a projection thereon adapted to be mounted in one of said square openings, said projection extending laterally and upwardly from said bar and being formed to fit closely within said openings, said projection extending outwardly from said bar at the bottom thereof, forming a seat for one of said openings in said rack, and the upper face thereof extending outwardly and upwardly from said bar.

* * * * *